US006121764A

United States Patent [19]

Stockstad

[11] Patent Number: 6,121,764

[45] Date of Patent: Sep. 19, 2000

[54] CURRENT SOURCE HAVING HIGH IMPEDANCE CURRENT OUTPUT AND METHOD THEREFOR

[75] Inventor: Troy Lynn Stockstad, Chandler, Ariz.

[73] Assignees: Maxim Integrated Products, Inc., Sunnyvale, Calif.; Gain Technology Corporation, Tucson, Ariz.

[21] Appl. No.: 09/313,151

[22] Filed: May 17, 1999

[51] Int. Cl.[7] ..... G05F 3/16

[52] U.S. Cl. ..... 323/315; 323/278

[58] Field of Search ..... 323/278, 312, 323/315

[56] References Cited

U.S. PATENT DOCUMENTS 5,055,719 10/1991 Hughes ..... 327/100
5,592,123 1/1997 Ulbrich ..... 323/313

*Primary Examiner*—Shawn Riley
*Attorney, Agent, or Firm*—Blakely, Sokoloff, Taylor & Zafman LLP

[57] ABSTRACT

Low voltage current sources having a high effective output impedance over a wide voltage range, including when individual transistors exhibit low output impedance states at low voltages. The low voltage current source replicates its output current and compares the replicated current to the desired current. The error between the replicated current and the desired current is used as feedback to force the output current to equal the desired current.

13 Claims, 3 Drawing Sheets

CURRENT SOURCE HAVING HIGH IMPEDANCE CURRENT OUTPUT AND METHOD THEREFOR

BACKGROUND OF THE INVENTION

1. Field of the Invention

The present invention relates to the field of current sources.

2. Prior Art

Current sources are widely used in integrated circuits for such purposes as providing the desired biasing for various circuit elements within the circuit. A common approach in the design of such circuits is to provide one or more current references onchip, and then to mirror each current source from the reference to a plurality of nodes in the circuit in accordance with the circuit node requirements. The current sources themselves may have various characteristics, such as being substantially temperature independent, being proportional to absolute temperature (PTAT), being dependent on the power supply voltage, being substantially independent of power supply voltage, etc.

Mirroring currents in this manner minimizes the number of individual current references needed, allows current ratios to be set by relative transistor sizes, and maintains current ratios in spite of process variations. However, mirroring currents in this manner results in mirrored current sources which do not always maintain the desired high output impedance over a wide operating voltage range of the current source, particularly for low voltage drops across the transistors to which the current is mirrored, as may be required in low voltage circuits. Preferably the current sources should maintain a high output impedance for voltage drops across the current sources of as little as a single $VCE_{(SAT)}$ for bipolar transistors or $V_{DS(sat)}$ for MOS transistors. In the prior art, high output impedance current sources could be achieved using a cascode current source, but this increases the headroom needed for the operation of the current source.

BRIEF SUMMARY OF THE INVENTION

Low voltage current sources having a high effective output impedance over a wide voltage range, including when individual transistors exhibit low output impedance states at low voltages. The low voltage current source replicates its output current and compares the replicated current to the desired current. The error between the replicated current and the desired current is used as feedback to force the output current to equal the desired current. Accuracy in the replicated current is assured by operating the transistors providing the output current and the replicated current under near identical conditions. Various embodiments are disclosed, including embodiments utilizing transistors of opposite conductivity type and embodiments using MOS transistors.

DETAILED DESCRIPTION OF THE PREFERRED EMBODIMENT

Figure 1:
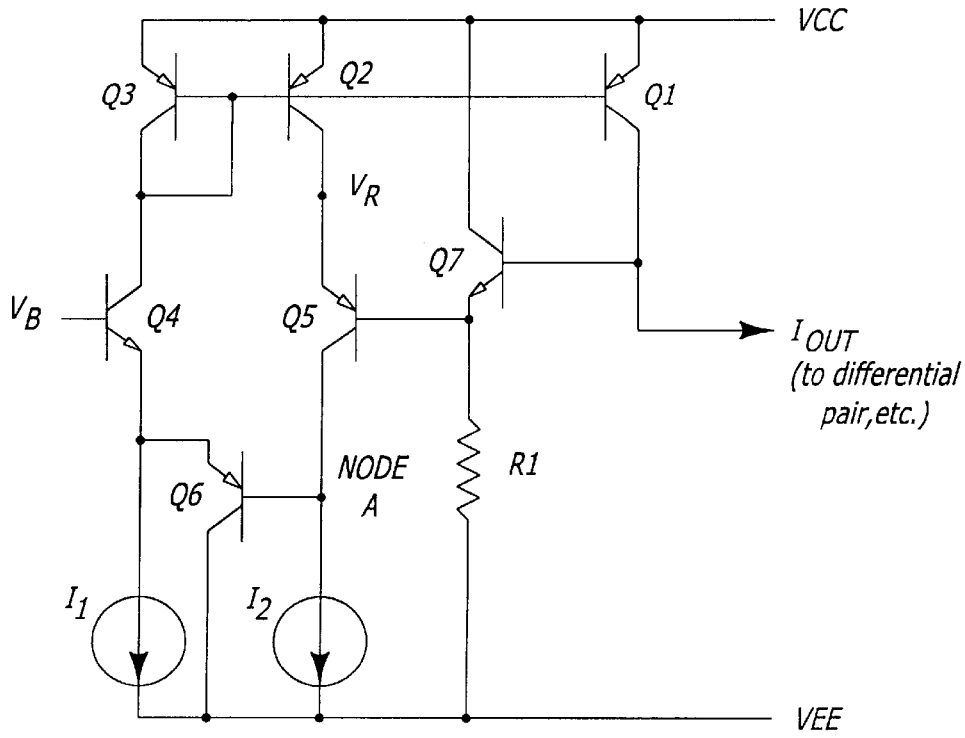
FIG. 1 is a circuit diagram of an exemplary embodiment of current source in accordance with the present invention.

First referring the FIG. 1, a circuit diagram for an exemplary embodiment of the present invention may be seen. The circuit shown is for sourcing an output current $I_{OUT}$. The circuit provides the collector current $I^{OUT}$ of transistor Q1 to the circuit utilizing the current of the current source (not shown), and has a high output impedance independent of the emitter-collector voltage of transistor Q1. In that regard, the phrases "current source" and "current sources" are generally used herein in the broad sense to include both current sources and current sinks. In the circuit of FIG. 1, transistor Q1 acts as a current source in the narrow sense, though as shall be subsequently seen, the circuit may be readily altered using devices of an opposite conductivity type to provide a current sink. However, both sources and sinks are referred to generally herein as current sources for convenience, as is common in the industry. Also, current sources $I_1$ and $I_2$ internal to the circuits, whether generated therein or mirrored from still another current source, are referred to herein and in the claims to follow as reference current sources to distinguish them from the overall circuit, itself collectively forming an improved current source. In the circuits disclosed, the current of current source $I_2$ is replicated as the output current $I_{out}$, with or without scaling.

In the circuit of FIG. 1, it will be assumed that the current sources I1 and I2 are substantially equal current sources, transistors Q2 and Q3 are of substantially equal size, and transistor Q1 is N times the size of transistors Q2 and Q3. N will typically range from 1 to some number larger than 1, such as by way of example, 10, though possible values of less than one are not to be excluded. For N>1, transistor Q1 may be a single larger transistor, or may be N transistors coupled in parallel, each substantially identical to transistor Q2. This provides better parameter matching characteristics between transistors Q2 and Q1 while still achieving the 1:N current ratio between transistors Q2 and Q1.

The bias voltage $V_B$ applied to the base of transistor Q4 sets the emitter voltage of transistor Q4, and thus, the headroom for the current source $I_1$, at 1 VBE below the bias voltage $V_B$. Similarly, the operating voltage for the current source $I_2$ is lower than the operating voltage for the current source $I_1$, by the VBE of transistor Q6. These current sources, of course, could be mirrored from still another current source having whatever characteristics are desired, such as being independent of temperature, proportional to absolute temperature, etc. In operation, the current through transistors Q3 and Q4 is mirrored to transistor Q2, and is also mirrored to transistor Q1 in a ratio of 1:N. Transistor Q7 is biased into conduction by the current through resistor R1 (an active current source could be used in place of resistor R1 if desired), setting the base voltage of transistor Q5 at 1 VBE below the output voltage for the output current $I_{OUT}$. However, the voltage $V_R$ is higher than the base voltage of transistor Q5 by the VBE of transistor Q5, so that the voltage $V_R$ quite accurately tracks the voltage on the collector of transistor Q1. Consequently, the voltage $V_R$ on the collector of transistor Q2 will follow the voltage on the collector of transistor Q1 (the output voltage associated with the output current $I^{OUT}$) Since transistors Q1 and Q2 have the same collector voltages, the same base voltages and the same emitter voltages, the ratio of currents in the two transistors will very accurately be 1:N, independent of the collector voltages. This will be true even when the collector voltages approach $VCE_{(SAT)}$, the collector emitter saturation voltage of the transistors.

The current in transistor Q2 flows through transistor Q5, to be compared with the current of current source $I_2$ at node A. If the current in transistor Q2 is less than the current of current source $I_2$, the voltage at node A will decrease, increasing the conduction in transistor Q6 to increase the current through transistors Q4 and Q3. The increased current through transistor Q3 increases the base emitter voltage of transistor Q3, similarly increasing the base emitter voltages of transistors Q2 and Q1. This will bring the current through transistor Q2 back to the current of current source $I_2$, and thus, the current through transistor Q1, $I_{OUT}$, back to N times the current through transistor Q2, or N times $I_2$. The net effect is that the output impedance of transistor Q1 is improved by a factor approximately equal to the beta of transistor Q6, a transistor not operating near saturation.

It may be seen from the foregoing description that a component of current in the collector of transistor Q6 is added to the current of current source $I_1$, to control the base emitter voltage of transistor Q3, and thus, the base emitter voltages of transistors Q2 and Q1, to control the currents there through to be equal to $I_2$ and N times $I_2$, respectively. To always provide that control, the various parameters of the circuit should be chosen such that the base current of transistor Q6 is preferably low, but does not go to zero under the worst operating conditions. This is a result of the fact that transistor Q6 can increase the current through transistor Q3 to greater than the current of current source $I_1$, but cannot reduce the current through transistor Q3 to less than the current of current source $I_1$. Consequently, the current of current source $I_1$, could be made to be slightly less that the current of current source $I_2$, transistor Q3 can be made slightly larger than transistor Q2, and/or some other slight skew provided, if desired or necessary, to assure that transistor Q6 is always at least slightly conducting throughout the range of input voltages and operating temperatures for the circuit.

Figure 2:
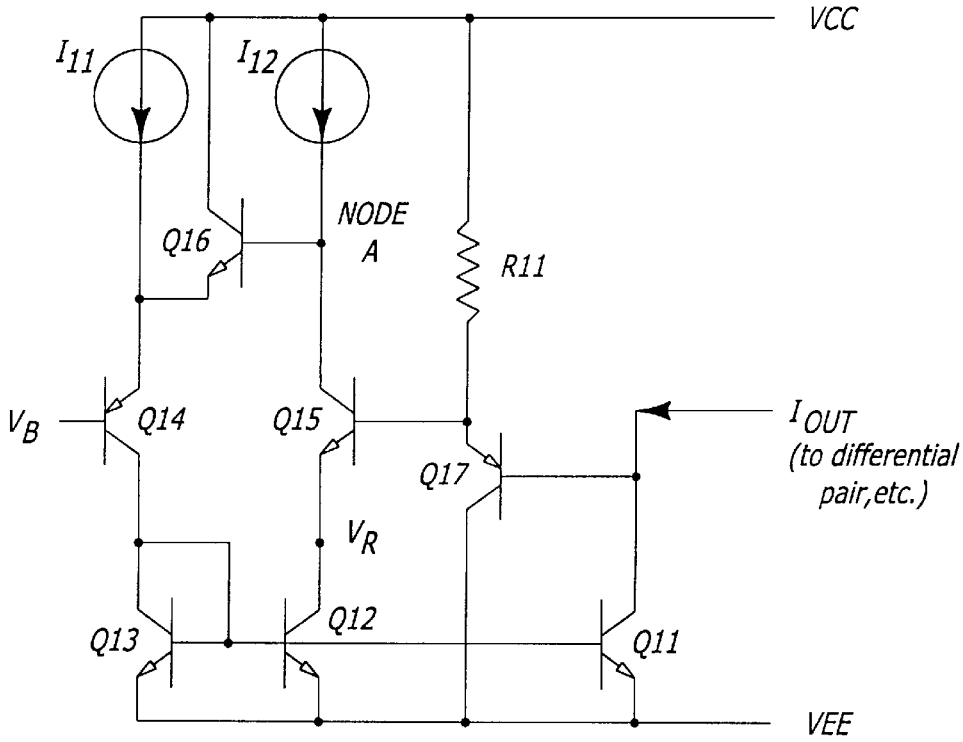
FIG. 2 is a circuit diagram of another exemplary embodiment of current source in accordance with the present invention.

The current source shown in FIG. 1 provides a current source referenced to the positive rail. In those applications where a current source referenced to the lower rail is required (to sink current), the circuit of FIG. 1 may be flipped vertically and all pnp transistors replaced with npn transistors, and vice versa. Such a circuit is shown in FIG. 2. In that circuit, current sources $I_{11}$ and $I_{12}$, resistors R11 and transistors Q11 through Q17 perform the same basic functions as current sources $I_1$ and $I_2$, resistor R1 and transistors Q1 through Q7 of FIG. 1, respectively.

Figure 3:
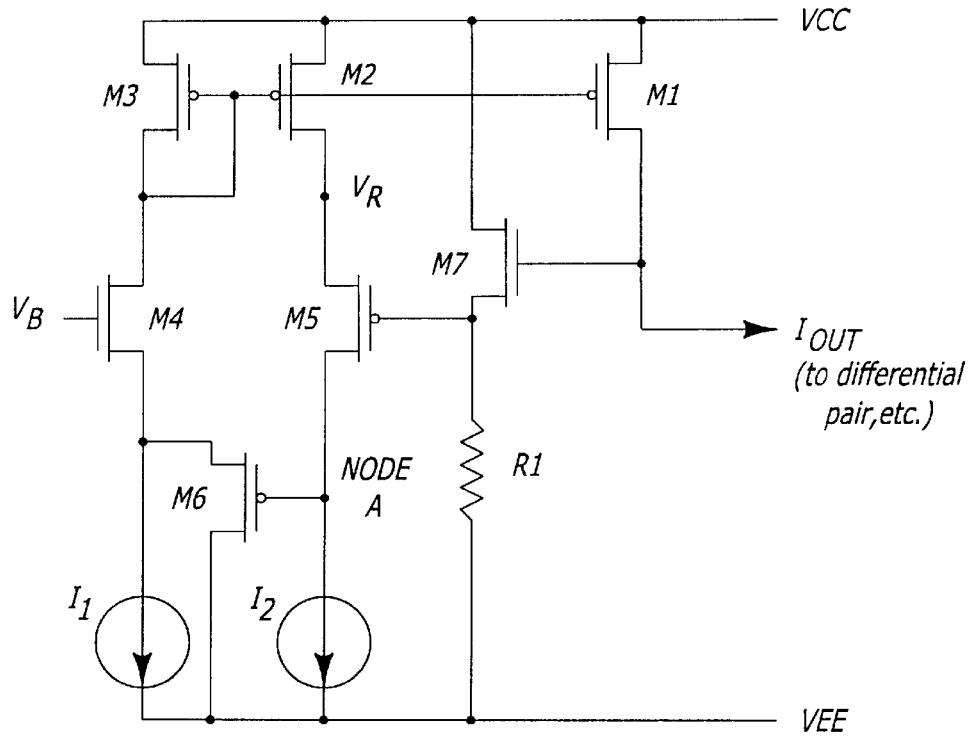
FIG. 3 is a circuit diagram of still another exemplary embodiment of current source in accordance with the present invention.
Figure 4:
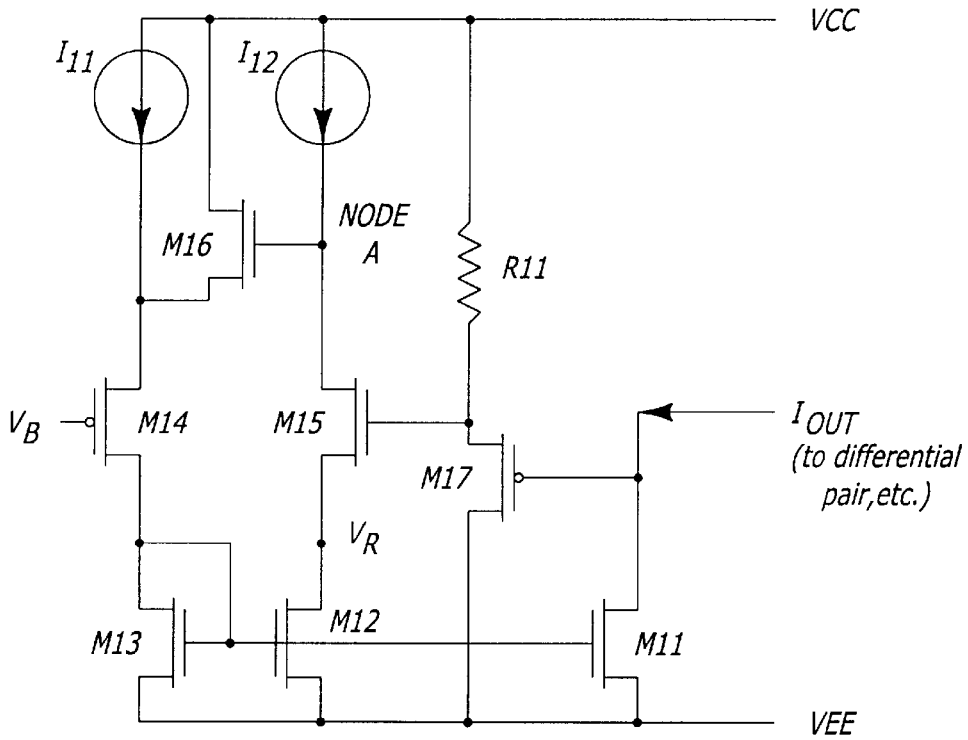
FIG. 4 is a circuit diagram of still another exemplary embodiment of current source in accordance with the present invention.

Instead of using bipolar junction transistors, other types of transistors may be used, such as MOS transistors. Thus, the circuit of FIG. 3 illustrates a MOS transistor equivalent to the circuit of FIG. 1, MOS transistors M1 through M7 replacing transistors Q1 through Q7 of FIG. 1. Finally, as before, a MOS realization of a current source in accordance with the present invention, referenced to the negative rail, is shown in FIG. 4. In this Figure, MOS transistors M11 through M17 duplicate the functions of transistors Q11 through Q17 of the circuit of FIG. 2.

Figure 5:
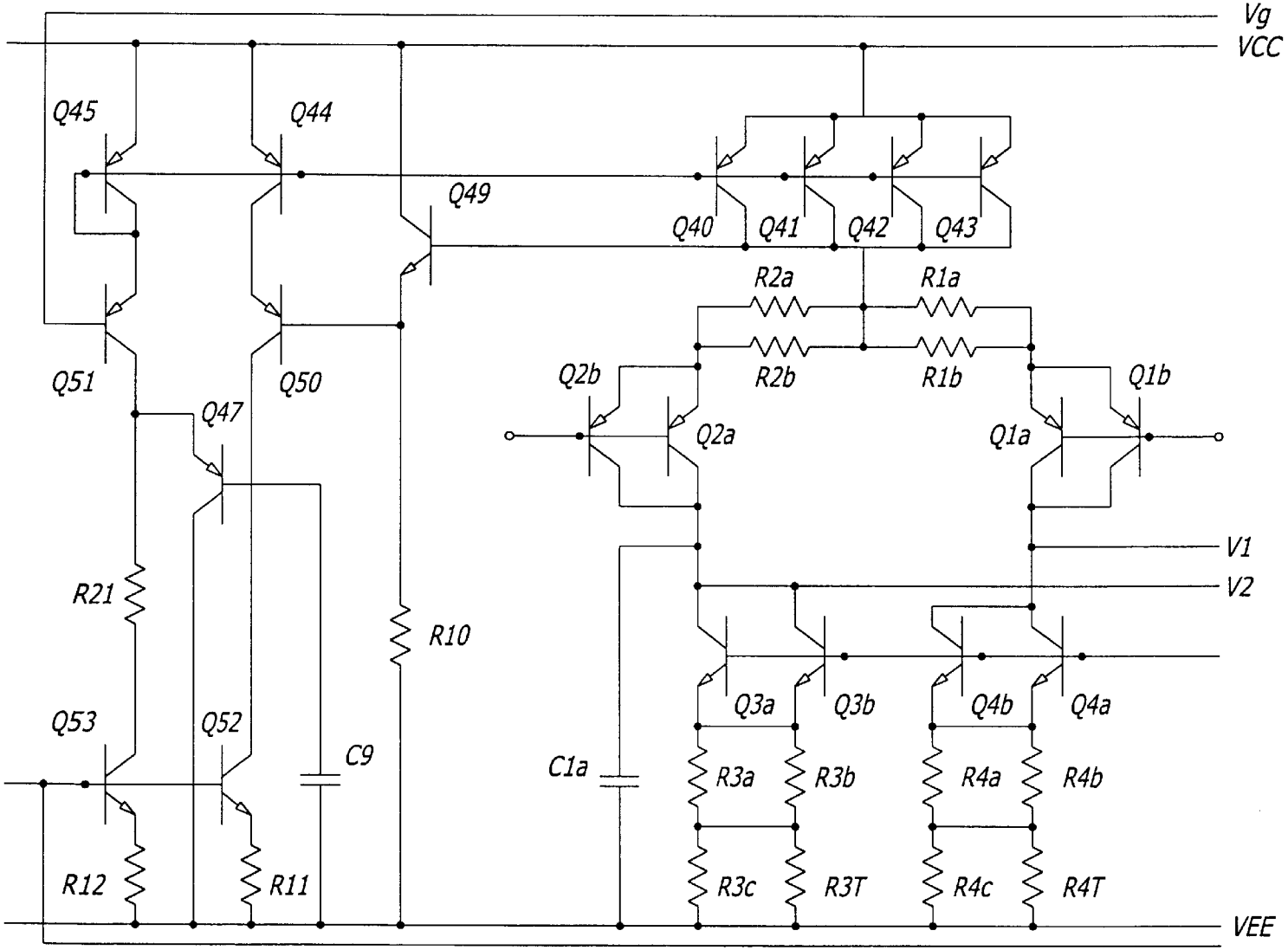
FIG. 5 is a circuit diagram of an exemplary differential amplifier input stage utilizing an exemplary embodiment of current source in accordance with the present invention.

The present invention current source may be used in many applications. The preferred embodiment of the present invention is used for biasing a differential transistor pair in input stages for operational amplifiers. An exemplary differential amplifier incorporating the current source of the present invention may be seen in FIG. 5. This circuit specifically incorporates a current source equivalent to that of FIG. 1. In FIG. 5, pnp transistors Q40, Q41, Q42 and Q43 together provide the equivalent of pnp transistor Q1 of FIG. 1, the four transistors connected in parallel providing the equivalent of a transistor having four times the area of each individual transistor. Transistors Q44 and Q45 are equivalent to transistors Q2 and Q3. Since transistors Q44 and Q45 are the same size as each of the transistors Q40 through Q43, the current source has a value of N equal to 4. In the circuit of FIG. 5, Q49 and Q50 are equivalent to transistors Q7 and Q5, respectively, with transistor Q47 being equivalent to transistor Q6. Transistors Q53 and Q52 mirror current from another current source and are thus equivalent to current sources $I_1$ and $I_2$ of FIG. 1. The differential amplifier itself is comprised of parallel differential pairs Q1A, Q1B and Q2A, Q2B, together with emitter degeneration resistors R1A, R1B and R2A, R2B. Transistors Q3A and Q3B, with resistors R3A, R3B, R3C and R3T, provide a current source (sink) for the collectors of transistors Q2A and Q2B by mirroring the current from another current source (not shown). Similarly, transistors Q4A and Q4B, together with resistors R4A, R4B, R4C and R4T, provide an equal current source (sink) for the collectors of transistors Q1A and Q1B. Thus, the nodes V1 and V2 become current summing points, with the nodes V1 and V2 providing a differential input to the next stage of the amplifier.

The advantage of using the current source of the present invention in an amplifier circuit such as that shown in FIG. 5 is that the current provided to the differential pair may be made substantially independent of the common mode voltage on the input to the differential input stage. This is true even when the common mode input is reasonably high, so that transistors Q40 through Q43 (FIG. 5) are approaching saturation. This assures that the gain of the differential stage is substantially independent of the common mode input voltage. The present invention current source allows the constant gain to be achieved even when the common mode input voltage more closely approaches the voltage of the associated rail than is characteristic of prior art amplifiers.

While the present invention has been disclosed and described with respect to certain specific embodiments thereof, it will be understood by those skilled in the art that various changes in form and detail may be made therein without departing from the spirit and scope of the invention.

What is claimed is:

1. A current source comprising:

first, second and third transistors, each having first and second terminals and a control terminal, the conduction through the respective transistor being responsive to the voltage between the control terminal and the first terminal, the first, second and third transistors having their first terminals coupled together and to a first power supply terminal, and their control terminals coupled together, the third transistor having its control terminal coupled to its second terminal to mirror current through the third transistor to the first and second transistors, the current in the second terminal of the first transistor forming a current output of the current source;

first and second reference current sources, the first reference current source being coupled to the second terminal of the third transistor and to a second power supply terminal, the second reference current source being coupled to the second terminal of the second transistor and to the second power supply terminal;

a first circuit coupling the voltage on the second terminal of the first transistor to the second terminal of the second transistor;

a second circuit coupling, with a current gain, and to the second terminal of the third transistor, the difference between the current of the second current source and the current mirrored to the second transistor.

2. The current source of claim 1 wherein the second circuit comprises a fourth transistor having first and second terminals and a control terminal, the conduction through the fourth transistor being responsive to the voltage between the control terminal and the first terminal, the first terminal of the fourth transistor being coupled to the first reference current source and the second terminal of the third transistor, the control terminal of the fourth transistor being coupled to the second reference current source and the second terminal of the second transistor, and the second terminal of the fourth transistor being coupled to the second power supply terminal.

3. The current source of claim 2 wherein the first circuit comprises fifth and sixth transistors, each having first and second terminals and a control terminal, the conduction through the respective transistor being responsive to the voltage between the control terminal and the first terminal, the fifth transistor having its first terminal coupled through a third current source to the second power supply terminal, its second terminal coupled to the first power supply terminal and its control terminal coupled to the second terminal of the first transistor, the sixth transistor having its first terminal coupled to the second terminal of the second transistor, its second terminal coupled to the control terminal of the fourth transistor and to the second reference current source and its control terminal coupled to the first terminal of the fifth transistor.

4. The current source of claim 3 wherein the third current source is a resistor.

5. The current source of claim 3 wherein the transistors are junction transistors.

6. The current source of claim 3 wherein the transistors are MOS transistors.

7. A current source providing a high impedance current output comprising:

a first transistor providing the current output of the current source;

a second transistor coupled to track the operating conditions of the first transistor and to conduct a current proportional to the current output of the first transistor;

a reference current source;

a third transistor coupled to the first and second transistors and the reference current source, the third transistor controlling the current of the first and second transistors responsive to the difference in the current of the second transistor and the reference current source.

8. The current source of claim 7 wherein the transistors are junction transistors.

9. The current source of claim 7 wherein the transistors are MOS transistors.

10. A method of providing a high impedance current source comprising:

providing first and second transistors, each having first and second terminals and a control terminal, the conduction through the respective transistor being responsive to the voltage between the control terminal and the first terminal, the first and second transistors having their first terminals coupled together and to a first power supply terminal, and their control terminals coupled together, the current in the second terminal of the first transistor forming the current output of the current source;

coupling the voltage on the second terminal of the first transistor to the second terminal of the second transistor; and, mirroring a current to the first and second transistors responsive to the difference between the current of a reference current source and the current in the second transistor.

11. A method of providing a current source with a high impedance current output comprising:

providing a first transistor, the current through the first transistor forming the current output of the current source;

coupling a second transistor to track the operating conditions of the first transistor and to conduct a current proportional to the current output of the first transistor;

controlling the current of the first and second transistors responsive to the difference in the current of the second transistor and a reference current source.

12. The current source of claim 11 wherein the transistors are junction transistors.

13. The current source of claim 11 wherein the transistors are MOS transistors.

* * * * *